US007046812B1

(12) United States Patent
Kochanski et al.

(10) Patent No.: US 7,046,812 B1
(45) Date of Patent: May 16, 2006

(54) ACOUSTIC BEAM FORMING WITH ROBUST SIGNAL ESTIMATION

(75) Inventors: Gregory P. Kochanski, Dunellen, NJ (US); Man M. Sondhi, Mountain Lakes, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/575,910

(22) Filed: May 23, 2000

(51) Int. Cl.
*H04R 3/00* (2006.01)

(52) U.S. Cl. ..... 381/92

(58) Field of Classification Search ..... 381/92, 381/95, 93
See application file for complete search history.

(56) References Cited

U.S. PATENT DOCUMENTS 4,802,227 A * 1/1989 Elko et al. ..... 381/92
5,339,281 A * 8/1994 Narendra et al. ..... 367/5
5,581,620 A * 12/1996 Brandstein et al. ..... 381/92
6,002,776 A * 12/1999 Bhadkamkar et al. ..... 381/66
6,049,607 A * 4/2000 Marash et al. ..... 379/406.08
6,449,586 B1 * 9/2002 Hoshuyama ..... 702/190
6,483,923 B1 * 11/2002 Marash ..... 381/92
6,594,367 B1 * 7/2003 Marash et al. ..... 381/92

* cited by examiner

*Primary Examiner*—Laura A. Grier

(57) ABSTRACT

Audio signals from any array of microphones are individually filtered, delayed, and scaled in order to form an acoustic beam that focuses the array on a particular region. Nonlinear robust signal estimation processing is applied to the resulting set of audio signals to generate an output signal for the array. The nonlinear robust signal estimation processing may involve dropping or otherwise reducing the magnitude of one or more of the highest and lowest data in each set of values from the resulting audio signals and then selecting the median from or generating an average of the remaining values to produce a representative, central value for the output audio signal. The nonlinear robust signal estimation processing effectively discriminates against noise originating at an unknown location outside of the focal region of the acoustic beam.

36 Claims, 4 Drawing Sheets

ACOUSTIC BEAM FORMING WITH ROBUST SIGNAL ESTIMATION

BACKGROUND OF THE INVENTION

1. Field of the Invention

The present invention relates to audio signal processing, and, in particular, to acoustic beam forming with an array of microphones.

2. Description of the Related Art

Microphone arrays can be focused onto a volume of space by appropriately scaling and delaying the signals from the microphones, and then linearly combining the signals from each microphone. As a result, signals from the focal volume add, and signals from else where (i.e., outside the focal volume) tend to cancel out.

One of the problems with a simple linear combination of signals is that it does not address the situation when noise occurs at or near one of the microphones in the array. In a simple linear combination of signals, such noise appears in the resulting combined signal.

These is prior art for canceling noise sources whose positions are known, such as those based on radar jamming countermeasures, where the delays and scales of the different microphones are adjusted to produce a null at the known position of the noise source. These techniques are not applicable if the position of the noise source is not well known, or if the noise is generated over a relatively large region (e.g., larger than a quarter wavelength across), or in a strongly reverberant environment where these are many echoes of the noise source.

Other prior art techniques for noise suppression, such as spectral subtraction techniques, operate in the frequency domain to attenuate the signal at frequencies where the signal-to-noise ratio is low. In the context of acoustic beam forming, such techniques would be applied independently to individual audio signals, either before the signals from the different microphones are combined or, after that combination, to the single resulting combined signal.

SUMMARY OF THE INVENTION

The present invention is directed to a technique for noise suppression during acoustic beam forming with microphone arrays when the location of the noise source is unknown and/or the frequency characteristics of the noise are not known. According to the present invention, noise suppression is achieved by combining the audio signals from the various microphones in an appropriate nonlinear manner.

In one implementation of the present invention, the individual microphone signals are filtered (e.g., shifted and scaled), but, instead of simply adding them as in the prior art, a sample-by-sample median is taken across the different microphone signals. Since the median has the property of ignoring outlying data, large extraneous signals that appear on less than half of the microphones are ignored.

Other implementations of the present invention use a robust signal estimator intermediate between a median and a mean. A representative example is a trimmed mean, where some of the highest and lowest samples are excluded before taking the man of the remaining samples. Such an estimator will yield better rejection of sound originating outside the focal volume. It will also yield lower harmonic distortion of such sound.

The present invention is computationally inexpensive, and does not require knowledge of the position of the noise source. It works well on spread-out noise sources that are spread out over regions small compared to the array size. It also has the additional bonus of rejecting impulse noise at high frequencies, even from sources that are not near a microphone.

Another advantage over the prior art is that the resultant signal from the present invention can be much less reverberant than can be produced by any prior art linear signal processing technique. In many rooms, sound waves will reflect many times off the walls, and thus each microphone picks up delayed echoes of the source. The present invention suppresses these echoes, as the echoes tend not to appear simultaneously in all microphones.

In one embodiment, the present invention is a method for processing audio signals generated by an array of two or more microphones, comprising the steps of (a) filtering the audio signal from each microphone to generate a processed audio signal for each microphone and combining the processed audio signals to form an acoustic beam that focuses the array on one or more three-dimensional regions in space; and (b) performing nonlinear signal estimation processing on the processed audio signals from the microphones to generate an output signal for the array, wherein the nonlinear signal estimation processing discriminates against noise originating at an unknown location outside of the one or more desired regions, where the term "noise" can be read to include delayed reflections of the original signal (i.e., reverberations).

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

Figure 1:
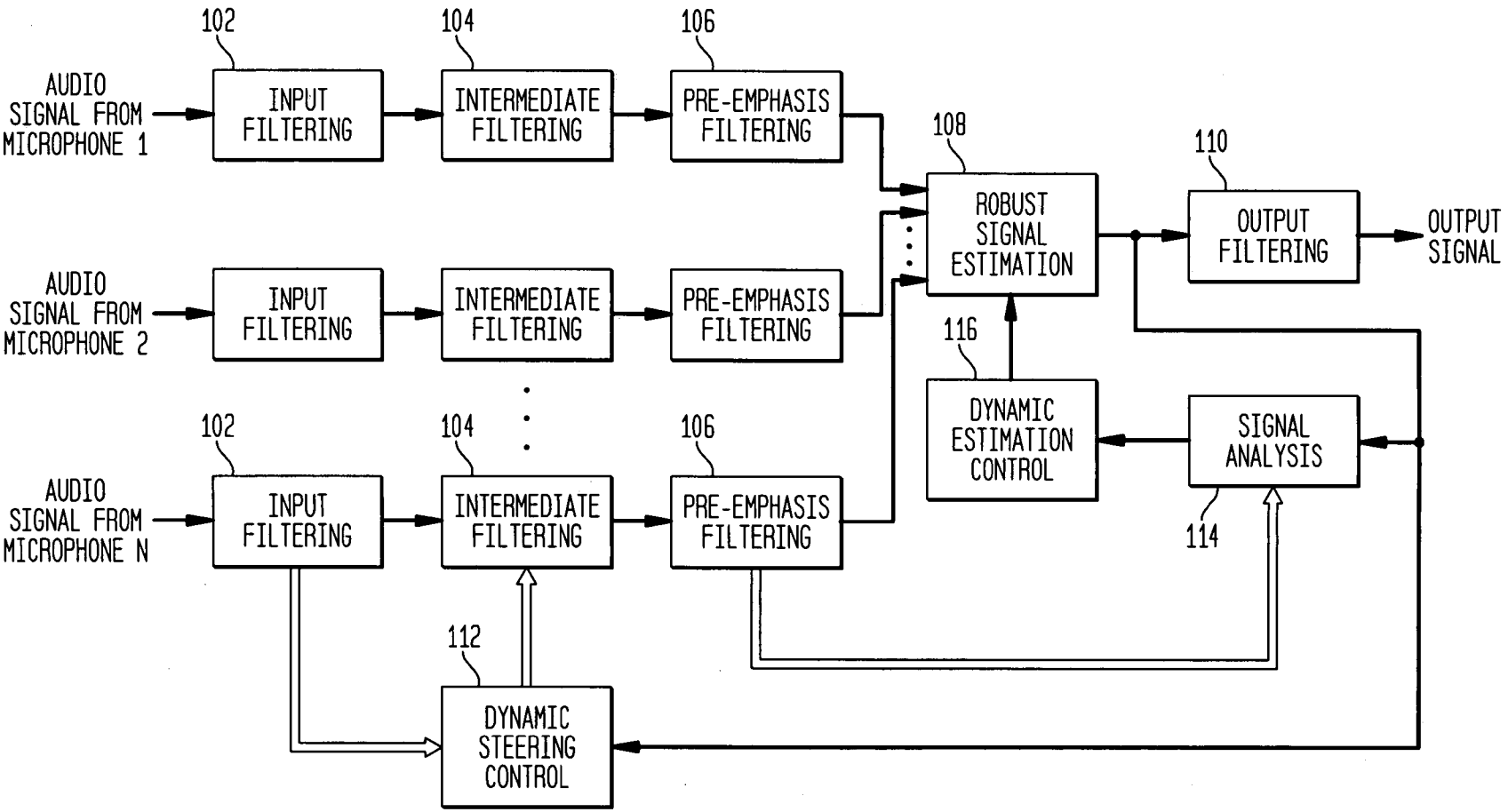
FIG. 1 shows a block diagram of audio signal processing performed to implement dynamic acoustic beam forming for an array of N microphones, according to one embodiment of the present invention.

FIG. 1 shows a block diagram of audio signal processing performed to implement dynamic acoustic beam forming for an array of N microphones, according to one embodiment of the present invention. As used in this specification, the term "acoustic signal" refers to the air vibrations corresponding to actual sounds, while the term "audio signal" refers to the electrical signal generated by a microphone in response to a received acoustic signal.

As shown in FIG. 1, the audio signal generated by each microphone is independently subjected to a processing channel comprising the steps of input filtering 102, intermediate filtering 104, and pre-emphasis filtering 106. Input filtering 102, which is preferably digital filtering, matches the frequency response of the corresponding combined microphone-filter system to a desired standard. In one embodiment, intermediate filtering 104 comprises delay and scaling filtering that delays and scales the corresponding digitally filtered audio signal so that, when the different audio signals are eventually combined (during robust signal estimation 108), they will form the desired acoustic beam. According to the present invention, an acoustic beam results from an array of two or more microphones, whose effective combined response is focused on one or more desired three-dimensional regions of space within a particular volume (e.g., a room).

In addition to or instead of delay and scaling, intermediate filtering 104 may contain a digital filter (e.g., a finite impulse response (FIR) filter). In one embodiment, where the system is used to reduce room reverberations, intermediate filtering 104 provides an approximate inverse to the room's transfer function. Although shown in FIG. 1 as separate elements, in other implementations, input filtering 102 and intermediate filtering 104 may be combined. In a preferred embodiment, after intermediate filtering 104, each audio signal is subjected to identical pre-emphasis filtering 106.

After pre-emphasis filtering 106, the N processed audio signals from the N microphones are combined according to a robust signal estimator 108, and the resulting combined audio signal is subjected to output (e.g., de-emphasis) filtering 110 to generate the output signal. Robust signal estimation 108 is described in further detail later in this specification. Output filtering 110, which may be implemented using a Wiener filter, is applied to shape the output spectrum and improve the overall signal-to-noise ratio.

As shown in FIG. 1, the audio signal processing provides dynamic control over the acoustic between steering implemented by the N intermediate filtering steps 104. In particular, dynamic steering control 112 receives the outputs from the N input filtering steps 102 (or, alternatively, the outputs from the N pre-emphasis filtering steps 106) as well as the final output signal from robust signal estimator 108 (or, alternatively, the output signal from output filtering 110) and generates control signals that dictate the amounts of delay and scaling for the N intermediate filtering steps 104. In a preferred embodiment, dynamic steering control 112 attempts to adjust each intermediate filter 104 such that the output from the corresponding pre-emphasis filter 106 matches (in both amplitude and phase) the output signal generated by output filter 110.

In addition, the audio signal processing of FIG. 1 provides dynamic control over the combining of audio signals implemented by robust signal estimation step 108. In particular, signal analysis 114 performs statistical analysis on the outputs from pre-emphasis filters 106 and the output signal from robust signal estimator 108 (or, alternatively, the output signal from output filtering 110) to generate statistical measures (e.g., the variance of the differences between the N inputs to robust signal estimator 108 and the output from robust signal estimator 108) used by dynamic estimation control 116 to dynamically control the operations of robust signal estimation 108. For example, when robust signal estimator 108 performs a weighted combination of audio signals, dynamic estimation control 116 dynamically adjusts the different weights applied by robust signal estimator 108 to the different audio signals from different microphones.

Note that the thick arrows in FIG. 1 flowing (1) from the column of input filters 102 to dynamic steering control 112, (2) from dynamic steering control 112 to the column of intermediate filters 104, and (3) from the column of pre-emphasis filters 106 to signal analysis 114 are intended to indicate that signals are flowing from all N of the input filters 102, to all N of the intermediate filters 104, and from all N of the pre-emphasis filters 106, respectively.

Either or both of the feedback loops in FIG. 1 may be omitted for particular embodiments that do not provide the corresponding type(s) of dynamic control over the audio signal processing.

The audio signal processing of FIG. 1, which uses a nonlinear operator to combine the various input signals, can be implemented in a low-delay pipelined manner. The combination step of robust signal estimation 108 preferably operates on a single sample (from each microphone), so the whole system can operate with delays much smaller than techniques that require a buffer to be accumulated and a transform (e.g., FFT) performed on the buffer. The output signal bears a definite phase relationship to the input signal, unlike many spectral subtraction techniques.

Robust Signal Estimation

Robust signal estimation 108 of FIG. 1 may be implemented in a variety of different ways that share the following similar nonlinear concept: each implementation picks a representative, central value from a collection of inputs by dropping or altering extreme data, such that the resulting central estimate is robust against (i.e., relatively insensitive to) wild variations of one input or possibly even a few inputs. With robust signal estimation according to the present invention, any one input value can vary from positive infinity to negative infinity without affecting the resulting output by more than a relatively small, finite amount.

One type of robust signal estimation is based on the median. In a median estimator, the individual microphone signals are individually filtered, shifted, and scaled, as indicated by the N parallel processing paths in FIG. 1, but, instead of being simply added as in prior-art techniques that rely on a linear combination of signals, the audio signals are "combined" in a nonlinear manner by taking the sample-by-sample median across the different microphone signals. In other words, at any given time, the output signal is selected as the median of the current values for the signals from the N microphones. Since the median has the property of ignoring outlying data, large extraneous signals that appear on less than half of the microphones will be effectively ignored.

Another type of robust signal estimation is based on a trimmed mean, where, for each set of current input values for the N microphones, one or more of both the highest and lowest input values are dropped, and the output is then generated as the mean of the remaining values. A trimmed mean estimator combines features of both a median (e.g., dropping the highest and lowest values) and a mean (e.g., averaging the remaining values). With large arrays, (e.g., 10 or more microphones), it may be advantageous to trim more than one datum on each end.

Another type of robust signal estimation is based on a weighted, trimmed mean, where, for each set of current input values for the N microphones, after one or more of the highest and lowest input values are dropped (as in the trimmed mean), one or more of the remaining highest and lowest inputs values (or even as many as all of the remaining inputs) are weighted by specified factors $w_i$ having magnitudes less than 1 to reduce the impact of these inputs when subsequently generating the output as the mean of the remaining weighted values.

Trimmed mean and weighted trimmed mean estimators, which are intermediate between a median and a mean, tend to yield less distortion for and also better rejection of sound originating outside the focal volume.

Another type of robust signal estimation is based on a Winsorized mean, which is calculated by adjusting the value of the highest datum down to match the next-highest, adjusting the lowest datum up to match the next lowest, and then averaging the adjusted points. As long as the second-highest and second-lowest points are reasonable, the extreme points can vary wildly, with little effect on the central estimate. With large arrays (e.g., ten or more microphones), it may be advantageous to "winsorize" (adjust) more than one datum on each end.

The different types of robust signal estimation described so far treat each set of input values independently. In other words, there is no filtering or integration that occurs over time. In alternative embodiments, the various types of robust signal estimation can be modified to use multiple samples from each microphone, either averaging over time or performing some other suitable type of temporal filtering. For example, a median-like operator can be implemented based on an arbitrary distance measure, which can be based on multiple samples for each microphone. For instance, the distance between two sequences can be defined to be a perceptually weighted distance, perhaps obtained by subtracting the sequences, convolving with a kernel, and squaring. At each sample, the microphone that "sounds" most typical can be identified and the output can then be selected as the signal from that microphone. The most-typical microphone could be defined as the one with the smallest sum of differences with respect to the other microphones, or using other techniques specially designed to exclude outliers.

Another implementation would be to use a single-sample estimator as described above, but dynamically change the weights given to each microphone, e.g., based on the ratio of power in the speech band to the power outside that band. This dynamic implementation can be implemented using the signal analysis 114 and dynamic estimation control 116 modules shown in FIG. 1.

In one sample implementation optimized for processing human speech, signal analysis 114 could calculate the amount of power output at each pre-emphasis filter 106 that is (1) coherent with the output of robust signal estimator 108 and (2) within a frequency band that contains most speech information (e.g., from about 100 Hz to about 3 kHz). It could also calculate the total power output from each of pre-emphasis filters 106. Dynamic estimation control 116 could then set the weight for each input to robust signal estimator 108 to be the ratio of the first power to the total power for that channel. Speech-like signals would then be given more weight. Likewise, signals that agree with the output of robust signal estimator 108 (and thus agree with each other) would also be weighted more heavily.

Setup

As suggested by the previous discussion of FIG. 1, before the audio signal processing algorithm is applied, the frequency response and phase delay of each microphone are measured. For each microphone, the corresponding input filter 102 is then set to match the frequency response of each combined microphone-filter system to a desired standard. The standard frequency response is typically set to be substantially flat between 100 and 10,000 Hz.

For a given source position (i.e., the desired acoustic beam focal point), the time delays and scaling levels for step 104 are then generated in order to match the phases and amplitudes of the audio signal in each channel. To get good noise rejection, the N scaling levels should be chosen so that, after the scaling of step 104, the audio signals will have the same magnitude in each channel.

Consider, for example, a trimmed mean estimator that drops the highest and lowest values, and then averages the rest. The noise suppression results from dropping the extreme points. Like many robust estimators, a trimmed mean estimator has the property that any single input value can vary from positive infinity to negative infinity, and yet change the resulting output by a finite amount. The majority of this change typically occurs when a given input, e.g., input j, is within $\Delta v_j \approx (\mathrm{var}\{v_i; i \neq j\})^{1/2}$ of the mean of $\{v_i; i \neq j\}$, where $v_i$ is the voltage on the ith input.

to get good noise rejection, the scaling levels should be chosen such that the resulting signals in the different channels have the same magnitude after intermediate filtering 104. This can be seen by considering the trimmed mean. The noise suppression results from dropping the extreme samples. If the input values to the robust estimator are widely spread (i.e., $\Delta v_j$ is large), then a noise signal on some channel must reach a relatively large amplitude before it becomes large enough to be dropped. To minimize the spread $\Delta v_j$ of the non-noisy input values, the amplitudes and phases of the signals input to robust signal estimation 108 are matched. Since the amplitudes are constrained to match each other, weights are introduced, which will allow some data to be marked as unimportant or noisy. These weights may be used by the robust estimator step.

In addition, it is desirable to minimize the generation of intermodulation distortion products in the robust estimator module. These products arise from the nonlinear nature of the robust estimator, and, for uncorrelated inputs, typically have amplitudes on the order of $\Delta V \approx (\mathrm{var}\{v_i\})^{1/2}/N$, where N is the number of input values. Again, this can be made small by matching the input voltages, but it can also be reduced by using a larger microphone array, thereby increasing N.

In a case where room reverberation is unimportant, the microphones are in the far field, and the dominant sound propagation is a direct path through free space. The desired time delays for filters 104 are then $t_i = (\max\{d_i\} - d_i)/c$, and the desired microphone gains for filters 104 are proportional to $d_i$, where $d_i$ is the distance from the source to the ith microphone, and c is the speed of sound. These choices work adequately in normally reverberant rooms, though the rejection of interfering signals will not be optimal, and some extra intermodulation distortion will be introduced.

In a more realistic system where echoes and other effects are important, or where higher quality sound is required, the delays and scalings would be generalized into full digital filters. For noise suppression, those filters are preferably chosen based on two criteria.

First, the desired signal (i.e., a signal from the focal volume) should appear nearly identical at the outputs of all of the intermediate filters 104. Any mismatch between the signals will both (1) increase the trimming threshold of the robust estimator 108, making the system more sensitive to unwanted signals and (2) introduce intermodulation distortion products into the output signal.

Second, the intermediate filters 104 should be chosen to have a compact impulse response in the time domain. As the filter's impulse response becomes longer, the energy of rogue signals (i.e., signals not from the focal volume) will be spread over more samples. As a result, they will not be trimmed as effectively by the robust estimator.

Generally, these criteria cannot be satisfied simultaneously, and a design will involve careful tradeoffs between the constraints, which conflict when the room's impulse response becomes long. Since the room's impulse response will vary from one microphone to another, exact matching of the desired signal on different channels would require digital filters whose impulse response is as long as the room's reverberation time. On the other hand, the rogue signals that are most easily rejected come from close to one microphone or another. In those cases, the room reverberation is relatively unimportant, since the rogue signals predominantly come on the direct path, not via reflections. Processing these rogue signals through a set of filters that is adjusted to match signals from the focal volume will generally spread the rogue signals and reduce their peak amplitude, so that they will not be cleanly trimmed away. For noise suppression, one needs to choose these matching filters to be a compromise between accurate matching of the desired signal and excessive broadening of rogue signals. On the other hand, a room de-reverberation application puts strong emphasis on matching the signals from the focal volume, and little or no emphasis on rejection of rogue signals that originate near a microphone.

For noise suppression, filters that make a good compromise can be calculated by minimizing the energy functional $\hat{\beta}$ over the space of all filters. The energy functional $\hat{\beta}$ measures the energy of rogue signals that can pass through the robust estimator, for a fixed sensitivity to signals that originate in the focal volume. Specifically, each microphone is imaginarily probed with a set of test signals $p_\alpha(\omega)$, whose peak amplitudes are adjusted to just match the estimator's trimming threshold. The energy coming out of the system is measured and then averaged over all microphones and all test signals.

In the case of a trimmed mean as a robust point estimator, the energy functional $\hat{\beta}$ is given by Equation (1) as follows:

$$\hat{\beta}(\{A_j\},\{w_j\}) = \sum_{\alpha,j} w_j^2 \left(\frac{T}{\hat{p}_{\alpha,j}}\right)^2 \int |p_\alpha(\omega)A_j(\omega)|^2 d\omega, \tag{1}$$

where $p_\alpha(\omega)$ is the probe pulse, $\alpha$ selects which of the test signals is applied, $A_j(\omega)$ is the gain of the jth channel input amplifier 104 and filter 106, $w_j$ is the weight given to the jth channel in the trimmed mean (under the constraint $$\left(\text{under the constraint } \sum_j w_j = 1\right),$$

and T is the trimming threshold. The peak amplitude of the probe pulse, after the amplifiers and filters is given by Equation (2) as follows:

$$\hat{p}_{\alpha,j} = \max\left|\int p_\alpha(\omega)A_j(\omega)e^{i\omega t}d\omega\right|. \tag{2}$$

As such, $T/\hat{p}_{\alpha,j}$ is the factor by which the probe pulse should be scaled to just reach the robust estimator's trimming threshold. The requirement for fixed sensitivity in the focal volume is given by Equation (3) as follows:

$$\sum_j H_j^d(\omega)A_j(\omega)w_j = 1, \tag{3}$$

where $H_j^d(\omega)$ is the transfer function for sound propagating from the desired source to the jth microphone. The constraint of Equation (3) has been assumed to eliminate the degeneracy of the solution for $\{w_j\}$. Relaxing this constraint applies an overall multiplier to the output signal.

The trimming threshold T should be calculated in the presence of a typical signal and a typical noise environment. The signal $s(\omega)$ from the focal volume (i.e., the desired signal) and noise $N_j(\omega)$ can be approximately by stationary random processes. It is also assumed that the noise is not correlated between microphones. This assumption of uncorrelated noise becomes invalid for small arrays at low frequencies, and will limit the applicability of this analysis for noisy rooms. It is further assumed that the trimmed mean is only lightly trimmed, so that the untrimmed mean is a good first estimate for the trimmed mean. Since the untrimmed mean is $s(\omega)$, the deviations from the untrimmed mean can be expressed by Equation (4) as follows:

$$\Psi_j(\omega) = H_j(\omega)A_j(\omega)w_j + s)\omega)(H_j^d(\omega)A_j(\omega) - 1)w_j, \tag{4}$$

in order to calculate Equation (5) as follows:

$$\text{var}\{v_j\} = \text{var}\{\Psi_j\} = \sum_j w_j^2 \int \left(|N_j(\omega)A_j(\omega)|^2 + |s(\omega)|^2 \cdot |H_j^d(\omega)A_j(\omega) - 1|^2\right) d\omega. \tag{5}$$

From there, it is assumed that $v_j$ has a reasonably Gaussian probability distribution. This condition is met if the signals are approximately Gaussian and their amplitudes are approximately equal. As such, the trimming threshold can be solved using Equation (6) as follows:

$$erf(T/(\text{var}\{v_j\})^{1/2}) = 1 - 2M/N, \tag{6}$$

which corresponds to trimming M microphones off each end of the probability distribution. Note that T is really a time-varying quantity, especially in a system with only a few microphones, and an approximation is made by giving it a single, constant value.

The best set of weights depends on the expected noise sources, how close to the microphone they are, and various psychoacoustic factors. In practice, a good solution is to set the threshold so that (on average) one or two microphones are trimmed away (M=0.5 or M=1). As M→N/2, the robust estimator approaches a median that typically yields too much distortion.

While the above equations may be solvable numerically in the general case, some insight can be gained analytically. A useful limit is where the incoherent noise $N_j(\omega)$ is small. Then, Equation (5), which sets the trimming threshold T, is dominated by the term proportional to s, and the trimming threshold T is proportional to the mismatch between the signals presented to the robust estimator. For free-space propagation, the strongest dependence of the energy functional $\hat{\beta}$ on any adjustable parameter (i.e., $w_j$ or $A_j(\omega)$ is through $T^2$, which leads to the intuitive result that it is best to match the signals at the input to the robust estimator. This limit is found to be useful for a room de-reverberation application.

Optimal Weights for Free-Space Propagation With Noise

Working with free-space propagation, the optimal weights can be extracted. In that case, $$H_j^d(\omega) = \frac{1}{d_j} e^{i\omega d_j/c} \tag{7}$$

and $$A_j(\omega) = 1/H_j^d(\omega) \tag{8}$$

If the root-mean-square (RMS) noise voltage at each input to the robust estimator is almost the same, i.e., $$\tilde{N}_j^2=\int |N_j(\omega)A_j(\omega)|^2\, d\omega \approx \tilde{N}, \tag{9}$$

then it can be shown that:

$$\hat{\beta} \propto \sum_{j,k} w_j^2 w_k^2 \tilde{N}_k^2, \tag{10}$$

Equation (1) simplifies dramatically because the transfer function times the gain is independent of frequency. One of the factors $w_j^2$ comes from Equation (1) and the other factors $w_k^2\tilde{N}_k^2$ come from Equation (5). The weights that optimize the energy functional $\hat{\beta}$ can be found analytically according to Equation (11) as follows:

$$w_j \propto (\tilde{N}_j/N)^{-3/2}. \tag{11}$$

Numerical experiments confirm the exponent, and show that this relationship is valid to within 20% for 20 microphones and $0.3<\tilde{N}_j/N<3$. Therefore, under these assumptions, the optimal weights are a function of distance form the source to the microphones, as given by Equation (12) as follows $$w_j \propto (d_j)^{-3/2}. \tag{12}$$

Optimal Amplifier Response

By taking a different limit, the optimal gain $A_j(\omega)$ can be calculated for a symmetrical microphone array, where noises are equal. For simplicity, the noise and signals may be assumed to be white. The transfer function is a direct path plus a single reflection, as given by Equation (13) as follows:

$$H_j(\omega)=d_j^{-1}e^{i\omega d_j/c}(1+\alpha_j e^{i\omega\tau_j}), \tag{13}$$

where $d_j$ is the distance of the microphone from the noise source, $\alpha_j$ is the echo strength (where $|\alpha_j|<<1$ is assumed), and $\tau_j$ is the delay associated with the echo. Assuming that the delay matches the echo, the amplifier gain A can be parameterized according to Equation (14) as follows $$A_j(\omega)=d_j e^{-i\omega d_j/c}(1+\gamma_j e^{i\omega\tau_j})^{-1}, \tag{14}$$

where $\gamma_j$ is the amplifier's response function. How completely the amplifiers should cancel the echo can be determined by finding the change to the amplifier's response function that will minimize the energy functional $\hat{\beta}$. Since this is a symmetric array, all of the distances are assumed identical.

The gain $A_j(\omega)$ can be calculated in the general case by decomposing the room impulse response function into individual echoes, and calculating $\gamma$ for each $\alpha$.

The most interesting term in this problem becomes the trimming threshold T, which is proportional to var $\{v_j\}$ via Equation (5) as follows:

$$T/erf^{-1}(1-2M/N)=\mathrm{var}\{v_j\}=N^2(1+\gamma^2)+S^2(\alpha-\gamma)^2 \tag{15}$$

neglecting higher-order terms in $\alpha$ and $\gamma$. For large signals, Equation (15) is dominated by the mismatch between the amplifier response and the transfer function, while, for small signals, it is dominated by the amplified noise.

The rest of the expression for the energy functional $\hat{\beta}$ is independent of S and N. For several interesting limits, it can also be shown to be independent of $\alpha$ and $\gamma$. Specifically, if the probe pulse is nearly Gaussian and has small autocorrelation at an interval of $\tau$, then:

$$\frac{\int |p_\alpha A_j(\omega)|^2 d\omega}{\hat{p}_{j,\alpha}} \tag{16}$$

is independent of $\alpha$ and $\gamma$. Minimizing the energy functional $\hat{\beta}$ is then equivalent to minimizing var$\{v_j\}$, the optimal value is given by Equation (17) as follows:

$$\gamma_{opt}=\alpha S^2/(S^2+N^2). \tag{17}$$

In the more general case of non-white spectra, the optimal value is given by Equation (18) as follows:

$$\gamma_{opt}=\alpha S^2/(S^2+\eta^2 N^2). \tag{18}$$

where $\eta$ is a function of the signal and noise spectral shapes, along with $\tau$.

Equation (17) can be used to guide the choice of amplifier response function under more complex conditions. To do this, the definition of the noise $N_j(\omega)$ needs analysis. The properties of the noise that are relied on in subsequent derivations are just that it is uncorrelated with the signal, and uncorrelated from one microphone to another. If the tail end of the transfer function of a reverberant room is considered, it is easy to see that it can share the same properties. For many signals (e.g., speech or music), the signal is non-stationary and changes every few hundred milliseconds. The reverberations become uncorrelated with the signal coming on the direct path, because the speaker has gone onto a new phoneme, while the listener still hears the reverberations of the previous phoneme. Likewise, microphone-to-microphone correlations disappear in the tail of the reverberation, especially at high frequencies, as each microphone sees a different sum of many randomly phased reflections from room surfaces. Equation (18) can then be applied to the situation, interpreting N as the diffusely generated noise plus the part of the room reverberation that is not cancelled out by the amplifiers.

With this model in mind, a good impulse response can be designed for the amplifiers, reflection by reflection. The process starts with the direct path, then applies Equation (18) to each image of the source in turn. At some point, $\gamma_{opt}$ will become small, because the individual reflections are exponentially diminishing in amplitude. At that point, the process stops, and all the power in the remaining reflections is treated as noise. In practice, the process may be limited first by changes in the room's transfer function, as sources and/or microphones move, or reflections off moving objects change.

Perceptual Weighting

In actuality, the model should be somewhat more complex than described above. The effect of the rogue probe pulse should be perceptually weighted in Equation (1), since larger intrusions can be tolerated at low and very high frequencies, and larger intrusions can be tolerated at frequencies and times where there is a lot of signal power. Adding the extra terms into the model will introduce a pre-emphasis filter 106 before the robust estimator 108, and a de-emphasis output filter 110 after. The pre-emphasis filter 106 will reduce the amplitude of perceptually unimportant noise (and thus reduce the trimming threshold by reducing the variance of the signals represented to the robust estimator). One implementation of filter 106 is to introduce a high-pass filter into amplifier 104, with a cutoff frequency of 50–100 Hz. Such a filter can drastically reduce the trimming threshold, by eliminating low-frequency rumble such as that caused by ventilation systems. In addition to improving the system's ability to reject rogue signals, removing the low-frequency rumble will reduce and possibly eliminate the intermodulation distortion products of the rumble, many of which could be at frequencies high enough to be annoying.

Experimental Procedure

The processing of FIG. 1 was simulated to test its behavior. All tests were done by calculating free-space sound propagation in a simulated room (a rectangular prism, extended with some added jitter in reflection positions and coupling between modes to simulate bounces off furniture and other deviations from perfect box-like geometry).

The simulated room was 7 m×3.5 m×3 m high, with reverberation times from 100 ms to 400 ms. Five microphones were used, four spaced in a line, 0.8 m apart, and one about 2.7 m from the line. The microphones were from 0.56 m to 2.7 m from the sound source, and the overall arrangement was designed to represent a press conference, with four microphones for speakers, and one extra on the ceiling. A heavily trimmed mean was used, with N=5, M=1, allowing the highest and lowest signals to be trimmed off at the robust estimator before the mean is calculated. As indicated earlier, system performance should improve with more microphones. The simulations were performed with just five microphones to show that the technique can be useful with practical, inexpensive systems.

A high-pass input filter 102 was placed after the microphones, with a 60-Hz cutoff frequency, to simulate removal of low-frequency ventilation system noise. The processing was implemented with an 12-kHz sampling rate and with the optimal weights $w_i \propto A_j^{-3/2}$ calculated using Equation (11) based on the assumption that the noise was equal at each microphone, where the amplifier gain A was independent of frequency.

Simulation Results: Distortion on Focus

In the first test, the nonlinearity of the system was measured by generating a tone burst with a Gaussian envelope (o=188 ms), then measuring the power at harmonics of the driving frequency, at the output of the system. The simulated room was lightly damped so the reverberation time was only 100 ms, and no noise was introduced. Under these conditions, the largest harmonic was the third, down 35 dB from the fundamental (median ratio, 70Hz–1800Hz). Under more reverberant conditions ($\tau_{reverb}$=400 ms), the third harmonic was down by 28 dB from the fundamental. The distortion would decrease as the number of microphones is increased.

Figure 2:
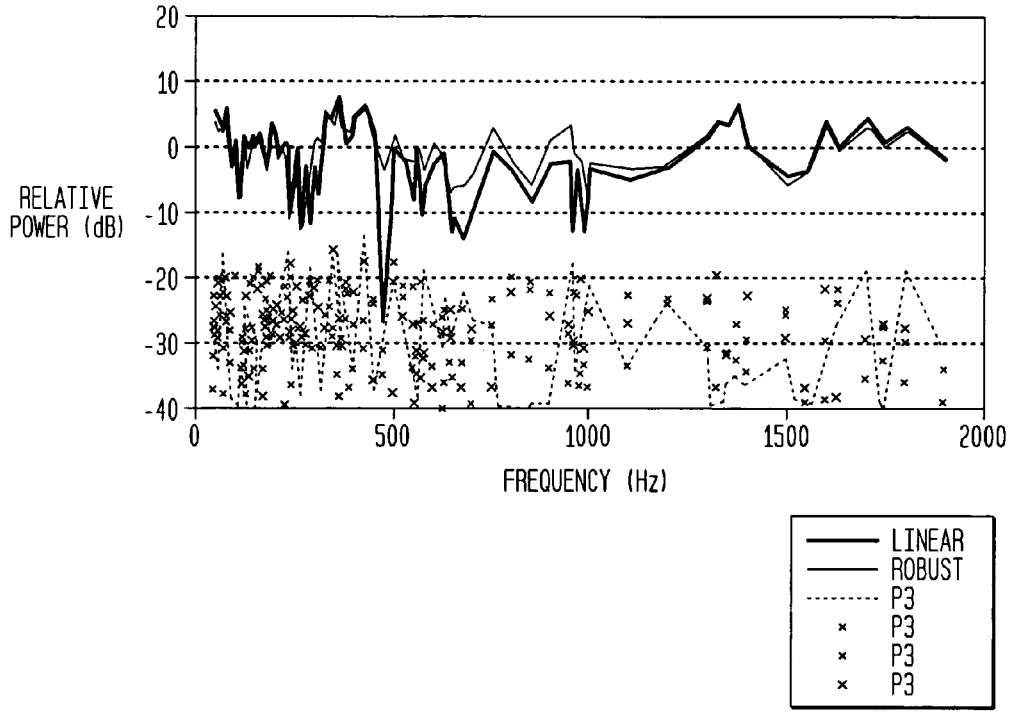
FIGS. 2–6 show results of simulations comparing a system having a robust signal estimator of the present invention with a system utilizing a prior-art linear combination of microphone signals.
Figure 3:
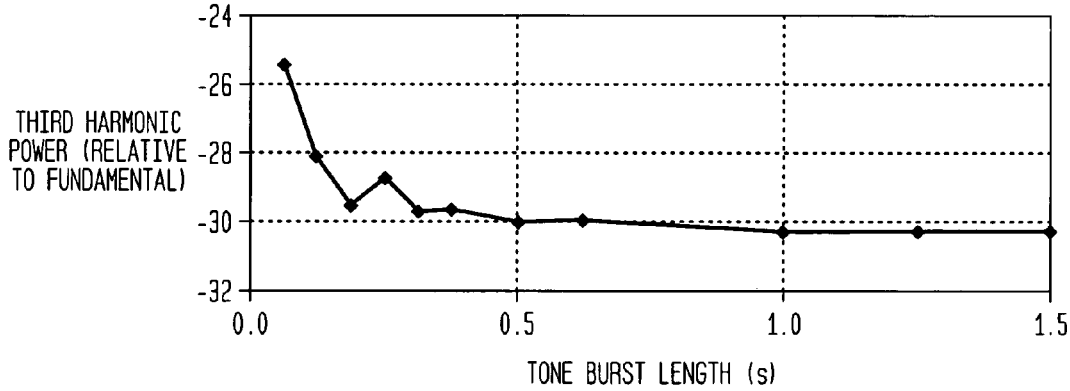

FIG. 2 shows the dependence on frequency for the reverberant case. The two topmost curves show the power at the signal frequency for the linear and robust systems. The lower (dotted) curve shows the third-harmonic power for the robust system, and the points scattered near the lower curve display the third-harmonic power for the robust system at three other choices of source and focus position. FIG. 3 shows the dependence of the distortion to the length of the tone burst.

Figure 4:
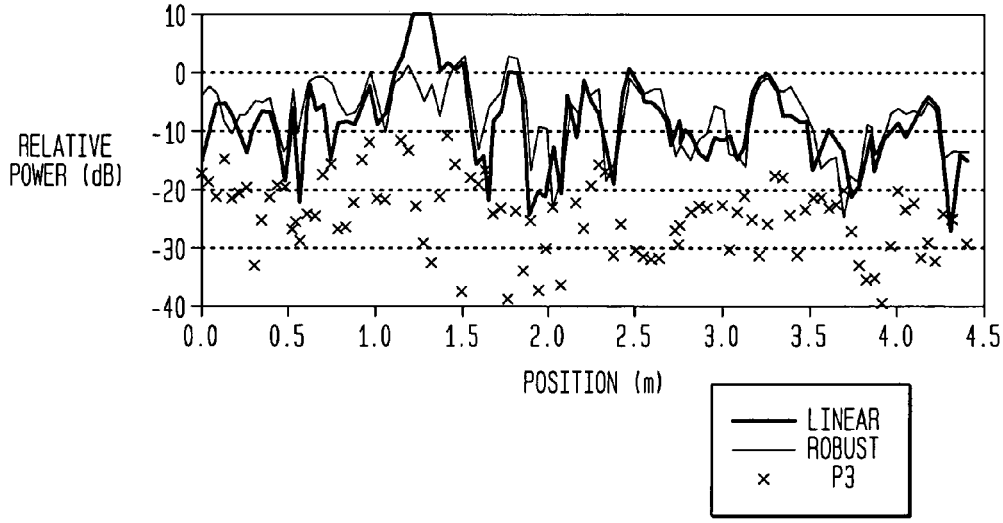

Distortion was also tested as a function of position, motivated by the observation that $P_{distort} \propto var(v_i)$, and that the array was adjusted to have a small $var(v_i)$ at the focus, and a generally increasing variance as the source goes away from the focus. FIG 4 shows the results of a test, where a tone burst source was scanned across the simulated room, and the system output was measured at the fundamental and at harmonics. Plotted is the average of tests at six frequencies between 300 Hz and 1500 Hz. The third harmonic is the largest, and its median is 25 dB below the on-focus signal. As expected, the fraction of power coming out in harmonics increases away from the focus, but that is loosely compensated by the reduction in total output power away from the focus, so that the power in the harmonics is roughly constant.

FIG. 4 shows the expected reduction in distortion. FIG. 4 shows power in the fundamental and harmonics from a tone-burst source at different positions across a room. In FIG. 4, the linear microphone array is shown in the thick black curve, the fundamental frequency output of the robust estimator is shown in the thin black curve, and the third-harmonic output of the robust estimator is shown as black crosses. The source passes over one of the microphones at 1.25 m, and passes through the array focus at 2.5 m.

Simulation Results: Suppression of Rogue Signals

A second test studied how well the system would suppress a signal from outside the focal volume. The simulated source was moved across a room with a 400-ms reverberation time while keeping to focus of the array fixed. The source produced a burst of band-limited Gaussian white noise (−3 dB at 1 kHz). Total energy was measured at the output of the system, waiting until the reverberations died away, and including any harmonic generation in the total.

Figure 5:
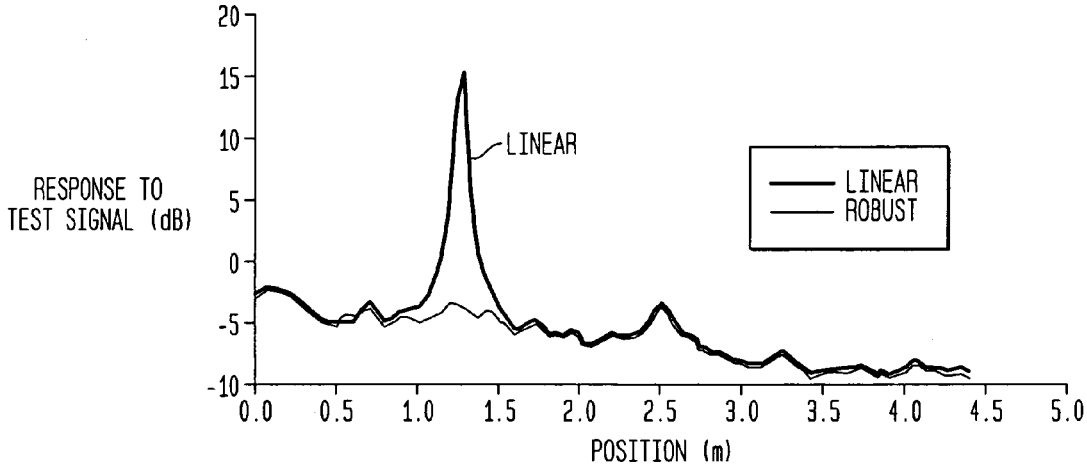

Ideally, a strong response is desired when the source is in the focal volume, and a much smaller response is desired to a source out of the focus. FIG. 5 shows results from this test for both a prior-art linear combination and a nonlinear robust signal estimation of the present invention. At d=2.5 m, the source was centered in the focal volume, and, at d=1.29 m, the source passes through one of the microphones. The linear system behaves very badly when the source is near the microphone. In particular, the power from the one close microphone gets so large that the amplitude of the output signal diverges, even though the source is well outside the focal volume. The nonlinear system, on the other hand, avoids this divergence by clipping away the signal from the one close microphone.

Right near the microphone, the system with the robust estimator can have a very large rejection of undesired signals, relative to the linear system. The robust estimator suppresses signals at 1 cm by <10 dB. Any noise source within 10 cm of any microphone will be suppressed by at least 3 dB. Sources close to unimportant microphones (e.g., those far from the focus, or those with a poor SNR) will be suppressed even more effectively and over a larger volume, since such microphones receive less weight in the robust combination operation.

Figure 6:
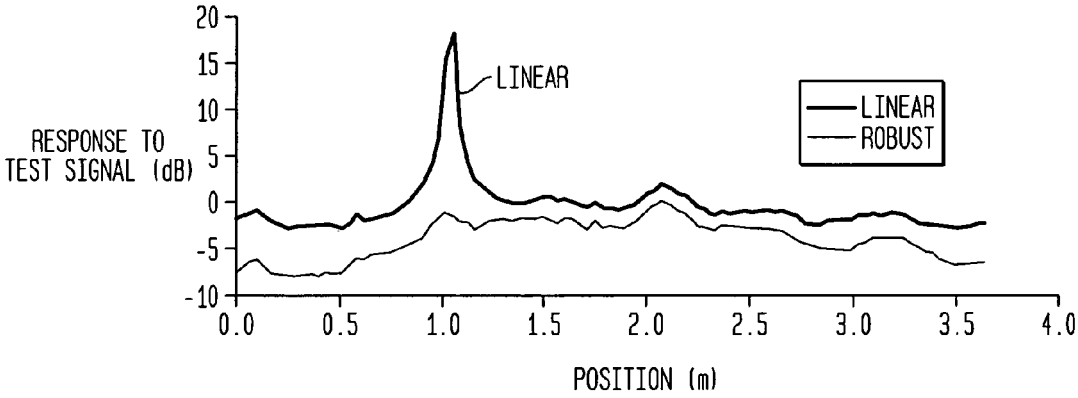

Often (as seen in FIG. 5), the robust microphone array of the present invention behaves very much like the linear array, except near microphones. However, under reasonable conditions, it is possible for the robust microphone array to have improved rejection of rogue signals over a large volume of space, as shown in FIG. 6. Here, the robust system produces at least a 3 dB better rejection ratio of rogue signals (relative to the focus) for d<1 m, and produces 2 dB better rejection for d>3 m. The explanation for this improved rejection relates to the fact that the set of voltages feeding into the robust estimator module 108 at any given instant is not likely to be particularly Gaussian, even if each signal, individually, has a Gaussian amplitude distribution. It turns out that this distribution is particularly non-Gaussian away from the focus. The long-tailed nature of the probability distribution of values into the robust estimator allows it to preferentially trim off the largest inputs, and to do a better job of rejecting signals out of the focal volume.

A toy model can be developed that shows the effect by working with white, Gaussian signals, frequency-independent amplifier gain, and by neglecting reflections. In this model, the appropriate gains are given by Equation (19) as follows:

$$G_j^d(\omega)=d^*_j e^{-i\omega d^*_j/c}, \tag{19}$$

where the superscript asterisk refers to the distances from the microphones to the focal point. The transfer function is given by Equation (20) as follows:

$$H_j^d(\omega)=\frac{1}{d_j}e^{i\omega d_j/c}, \tag{20}$$

evaluated at the distance from the interfering source to the microphone.

At the focal volume, the amplifier delays are set to cancel the propagation delays, so the signals at each input to the robust estimator module are highly correlated, and actually identical in this model. The variance of the inputs is zero, and the output of any central estimator, robust or not, is equal to the average of the inputs.

Almost everywhere away from the focus, where $d_j \neq d^*_j$, the amplifier delays do not match the propagation delay, and each input to the robust estimator modulate sees a statistically independent sample. The estimator inputs are then given by Equation (21) as follows:

$$v_j=\frac{d_j^*}{d_j}\eta_j, \tag{21}$$

where $\eta_j$ are a set of independent, Gaussian random variables, with zero means and variance proportional to the signal power. It may be assumed that $\mathrm{var}(v_j)=1$ without loss of generality.

The probability distribution of $\{v_j\}$ is then a mixture of several Gaussians according to Equation (22) as follows:

$$P(v)=\frac{1}{n}\sum_j \frac{1}{\sqrt{2\pi r_j^2}}e^{-v^2/2r_j^2}, \tag{22}$$

which is therefore non-Gaussian unless all $$r_j \equiv \frac{d_j^*}{d_j}=\bar{r}.$$

In three-dimensional space, with three or ore microphones, the only point that makes P(v) strictly Gaussian is the focus. Elsewhere, some robust estimator will produce lower variance (and thus a lower output power) than the equivalent linear combination. If P(v) is far enough from a Gaussian, then the system will give a noticeable suppression for rogue signals.

From the toy model, it can be seen that the largest effect will occur when one or more of the ($\{r_j\}$ differ strongly from unity. This happens most strongly when one of the $\{r_j\}$ approaches zero. This is the 'expected' case, where the noise source is close to a microphone. However, it also happens when one of the $\{r(_j\}$ is small (i.e., when the focus is close to a microphone}. In this latter, unexpected case, P(v) can be noticeably non-Gaussian almost everywhere in the room, and the system can exhibit substantially better directivity than a linear system.

Application: Room De-Reverberation

A room de-reverberation application applies the same core technique (use of a robust estimator to combine several microphone signals) in an iterative manner. In brief, the technique involves a microphone array focused on a desired signal source. Given an output signal, the digital filters on each microphone are adjusted to match all the microphone signals to that output signal. By matching all the microphone signals, the variance of the data going into the robust estimator is reduced, which will reduce the amount of distortion generated on the next pass.

For this application, it is simpler to describe the algorithm as if all the data had been collected in advance, and stored data is being processed to find the optimal signal. Those skilled in the art can transform the description from an off-line post-processing system to an on-line system. One possible transformation to an on-line system is to assume that the room and source position change relatively slowly. The outputs from dynamic steering control 112 and dynamic estimation control 116 can then be calculated as time averages of quantities. One "pass" of the algorithm then corresponds roughly to the averaging time. The averaging time should be set long enough to get a sufficiently broad sample of the source signals, yet short enough so that the digital filters 104 and robust signal estimator 108 can be adapted to follow changes in the room acoustics. Alternatively, the entire system shown in FIG. 1 could be copied once for each pass, where the outputs of control modules 112 and 116 in the $n^{th}$ could affect the filters in the $(n+1)^{st}$ pass. Multiple copies of the system are relatively easy for a software implementation.

Typically, after a few iterations, the algorithm converges to a solution where the generated distortion is low, and the output signal is close to the source signal. In cases where there are no noise sources, the algorithm will often converge to zero distortion, where the output is related to the source signal by a simple linear filter.

A preferred implementation contains steps for heuristically generating an estimate of the source spectrum (Step 7), and using that estimate to match the spectrum of the output signal to the spectrum of the source (Step 8). Other estimates of the source spectrum are possible for Step 7 . Likewise, Step 8 generates a filter from knowledge of the power spectrum, without phase information. Should phase information be available, a person skilled in the art could use it to generate a better filter for Step 8.

This preferred implementation comprises the following steps:

Step 1: Read in the several microphone signals into $m_j(t)$ after correcting microphone frequency response with input filtering 102 of FIG. 1.

Step 2: Initialize FIR filters (i.e., 104 or equivalently $H_j(t)$) to align signals and to make their amplitudes match as well as possible.

Step 3: Filter the microphone signals with filters 104 and 106, according to Equation (23) as follows:

$$s_j(t)=m_j(t)\oplus H_j(t). \tag{23}$$

The signals $s_j(t)$ should be nearly equal and nearly time aligned at the end of this step.

Step 4: Apply the robust estimator 108 to get a single signal estimate, according to Equation (24) as follows:

$$q(t)=\text{Robust}(\{s_j(t)\}) \tag{24}$$

Step 5: Find the best linear FIR filters $h_j(t)$ (subject to length and other constraints), such that:

$$q(t)\approx m_j(t)\oplus h_j(t). \tag{25}$$

This is the construction of a linear predictor from m to q.

Step 6: Estimate the power spectrum $Q(\omega)$ of q(t), via fast Fourier transform.

Step 7: Calculate a single, representative power spectrum for the source signal from the several microphone signals. Typically, one takes the median (at each frequency) of power spectra from the microphone signals, such that:

$$p(\omega)\leftarrow\text{median \& FFT}(m_j(\omega)). \tag{26}$$

Step 8: Construct a filter $f(\tau)$, whose transfer function (in the frequency domain) has magnitude $p(\omega)/Q(\omega)$ (except where Q is too small). One must be prepared to heuristically adjusts Q to make sure the denominator does not go near zero, but it rarely does, in practice. Typically, one constrains the length of the resulting filter in the time domain and/or trades off accuracy of the magnitude for a reduced norm of the filter.

Step 9: Construct updated filters for each channel $H^*_j(t)$ via:

$$H^*_j(t)=h_j(t)\oplus f(t). \tag{27}$$

These filters fulfill two purposes. First, they make the microphone signals as close as possible to the output of the robust estimator (and therefore, they are also close to each other). Second, they match the overall output of the system to the estimate of the source's spectrum.

Step 10: Decide if the algorithm has converged well enough to stop, or whether it should update the filters and loop around again. The decision is based on how close $H^*_j(t)$ is to $H_j(t)$, and/or how close the microphone signals match, after processing through the two versions of the filter.

Step 11: If the algorithm needs more iterations, update $H_j(t)$. Typically, one would use:

$$H_j(t)\leftarrow\mu\cdot H_j(t)+(1-\mu)\cdot H^*_j(t) \tag{28}$$

$-1<\mu<1$, but other updating schemes could also be derived. When the algorithm converges, q(t) is an estimate of the source signal, without room reverberations, and $H_j(t)$ are estimates of the room transfer function. Distortion levels can be very low, if $H_j(t)$ converges to something close to the real room transfer function.

Using a robust estimator according to the present invention (e.g., a trimmed means or a median) to combine microphone signals can produce better directivity than a prior-art linear combination, when either a noise source or the focus is close to a microphone, with minimal degradation in other cases. The computational cost is low, and it does not make any assumptions about what the characteristics of either the noise or the signal are. For example, someone can tap his or her finger on any microphone in the array and hardly disturb the output.

The present invention is computationally inexpensive, and does not require knowledge of the position of the noise source. It works on spread-out noise sources, so long as they are spread out over regions small compared to the array size. It also has the minor additional bonus of rejecting impulse noise at high frequencies, even from sources that are not near a microphone.

The present invention may be implemented as circuit-based processes, including possible implementation on a single integrated circuit. As would be apparent to one skilled in the art, various functions of circuit elements may also be implemented in the digital domain as processing steps in a software program. Such software may be employed in, for example, a digital signal processor, micro-controller, or general-purpose computer.

While the exemplary embodiments of the present invention have been described with respect to processes of circuits, including possible implementation as a single integrated circuit, the present invention is not so limited. As would be apparent to one skilled in the art, various functions of circuit elements may also be implemented in the digital domain as processing steps in a software program. Such software may be employed in, for example, a digital signal processor, micro-controller, or general purposes computer.

The present invention can be embodied in the form of methods and apparatuses for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into an executed by a machine, such as a computer, the machine becomes an apparatus for practicing the invention. When implemented on a general-purpose processor, the program code segments combine with the processor to provide a unique device that operates analogously to specific logic circuits.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the scope of the invention as expressed in the following claims.

What is claimed is:

1. A method for processing audio signals generated by an array of two or more microphones, comprising the steps of:

(a) filtering by delaying and scaling the audio signal from at least one microphone to generate a processed audio signal for each microphone; and (b) combining the processed audio signals for the two or more microphones in a nonlinear manner that suppresses effects of high values to form an acoustic beam that focuses the array on one or more desired regions in space by performing nonlinear signal estimation processing on the processed audio signals from the microphones to generate an output signal for the array, wherein:

the nonlinear signal estimation processing discriminates against noise originating at an unknown location outside of the one or more desired regions; and the nonlinear signal estimation processing picks a representative, central value from the processed audio signals for the two or more microphones, by altering at least one extreme value from at least one of the processed audio signals for the two or more microphones.

2. The invention of claim 1, wherein step (a) comprises the step of applying a digital filter corresponding to the inverse of each transfer function from a desired focal point to each microphone to compensate for reverberation in a volume containing the array.

3. The invention of claim 1, wherein the output signal is processed in a feedback loop to generate control signals that adjust the nonlinear signal estimation processing of step (b).

4. The invention of claim 3, wherein the control signals adjust weights applied to the processed audio signals during the nonlinear signal estimation processing of step (b).

5. The invention of claim 4, wherein a weight for each processed audio signal is based on a ratio of power in a speech band to power outside the speech band for the processed audio signal.

6. The invention of claim 3, wherein the output signal is processed in another feedback loop to generate other control signals that adjust the filtering of step (a) to attempt to match each of the processed audio signals.

7. The invention of claim 1, wherein the output signal is processed in a feedback loop to generate control signals that adjust the filtering of step (a).

8. The invention of claim 1, wherein the filtering of step (a) is dynamically adjusted to attempt to match each of processed audio signals.

9. The invention of claim 8, wherein the filtering of step (a) is dynamically adjusted to attempt to match each of the processed audio signals in amplitude and phase to each other and to the output signal.

10. The invention of claim 1, wherein the nonlinear signal estimation processing comprises the step of selecting the representative, central value as a median of the processed audio signals.

11. The invention of claim 1, wherein the nonlinear signal estimation processing comprises the steps of:

(1) adjusting the magnitude of one or more of at least one of the highest and lowest values of the processed audio signals to generate a set of adjusted audio signals; and (2) selecting the representative, central value as a median or average of the adjusted audio signals.

12. The invention of claim 11, wherein:

step (1) comprises the steps of:

(i) adjusting the value of the n highest values down to match the $(n+1)^{th}$ highest data value, where n is a non-negative integer; and (ii) adjusting the value of the m lowest values up to match the $(m+1)^{th}$ lowest data value, where m is a non-negative integer; and step (2) comprises the step of selecting the representative, central value as an average of the processed audio signals.

13. The invention of claim 12, wherein the average is a weighted average.

14. The invention of claim 1, wherein the nonlinear signal estimation processing comprises the steps of:

(1) dropping one or more of the highest and lowest values of the processed audio signals to generate a set of adjusted audio signals; and (2) selecting the representative, central value as an average of the adjusted audio signals.

15. The invention of claim 14, wherein the average is a weighted average.

16. The invention of claim 1, wherein the nonlinear signal estimation processing treats each set of input values for the processed audio signals independently.

17. The invention of claim 1, wherein the nonlinear signal estimation processing is based on multiple values from each processed audio signal over a period of time.

18. The invention of claim 17, wherein the nonlinear signal estimation processing comprises the step of applying temporal filtering to the input values of each processed audio signal.

19. The invention of claim 18, wherein the nonlinear signal estimation processing further comprises the steps of generating a distance measure between pairs of audio signals and generating the output signal from the one or more audio signals having the smallest distance measures with other audio signals.

20. A machine-readable medium, having encoded thereon program code, wherein, when the program code is executed by a machine, the machine implements a method for processing audio signals generated by an array of two or more microphones, comprising the steps of:

(a) filtering by delaying and scaling the audio signal from at least one microphone to generate a processed audio signal for each microphone; and (b) combining the processed audio signals for the two or more microphones in a nonlinear manner that suppresses effects of high values to form an acoustic beam that focuses the array on one or more desired regions in space by performing nonlinear signal estimation processing on the processed audio signals from the microphones to generate an output signal for the array, wherein:

the nonlinear signal estimation processing discriminates against noise originating at an unknown location outside of the one or more desired regions; and the nonlinear signal estimation processing picks a representative, central value from the processed audio signals for the two or more microphones, by altering at least one extreme value from at least one of the processed audio signals for the two or more microphones.

21. A method for processing audio signals generated by an array of two or more microphones, comprising the steps of:

(a) filtering by delaying and scaling the audio signal from at least one microphone to generate a processed audio signal for each microphone; and (b) combining the processed audio signals for the two or more microphones in a nonlinear manner to form an acoustic beam that focuses the array on one or more desired regions in space by performing nonlinear signal estimation processing on the processed audio signals from the microphones to generate an output signal for the array, wherein the nonlinear signal estimation processing discriminates against noise originating at an unknown location outside of the one or more desired regions, wherein the output signal is processed in a feedback loop to generate control signals that adjust the nonlinear signal estimation processing of step (b).

22. The invention of claim 21, wherein the control signals adjust weights applied to the processed audio signals during the nonlinear signal estimation processing of step (b).

23. The invention of claim 22, wherein a weight for each processed audio signal is based on a ratio of power in a speech band to power outside the speech band for the processed audio signal.

24. The invention of claim 21, wherein the output signal is processed in another feedback loop to generate other control signals that adjust the filtering of step (a) to attempt to match each of the processed audio signals.

25. A method for processing audio signals generated by an array of two or more microphones, comprising the steps of:

(a) filtering by delaying and scaling the audio signal from at least one microphone to generate a processed audio signal for each microphone; and (b) combining the processed audio signals for the two or more microphones in a nonlinear manner to form an acoustic beam that focuses the array on one or more desired regions in space by performing nonlinear signal estimation processing on the processed audio signals from the microphones to generate an output signal for the array, wherein the nonlinear signal estimation processing discriminates against noise originating at an unknown location outside of the one or more desired regions, wherein the output signal is processed in a feedback loop to generate control signals that adjust the filtering of step (a).

26. The invention of claim 25, wherein the fitering of step (a) is dynamically adjusted to attempt to match each of the processed audio signals.

27. The invention of claim 26, wherein the filtering of step (a) is dynamically adjusted to attempt to match each of the processed audio signals in amplitude and phase to each other and to the output signal.

28. A method for processing audio signals generated by an array of two or more microphones, comprising the steps of:

(a) filtering by delaying and scaling the audio signal from at least one microphone to generate a processed audio signal for each microphone; and (b) combining the processed audio signals for the two or more microphones in a nonlinear manner to form an acoustic beam that focuses the array on one or more desired regions in space by performing nonlinear signal estimation processing on the processed audio signals from the microphones to generate an output signal for the array, wherein the nonlinear signal estimation processing discriminates against noise originating at an unknown location outside of the one or more desired regions, wherein the nonlinear signal estimation processing picks a representative, central value from the processed audio signals for the two or more microphones, by altering at least one extreme value from at least one of the processed audio signals for the two or more microphones, wherein the nonlinear signal estimation processing comprises the steps of:

(1) adjusting the magnitude of one or more of at least one of the highest and lowest values of the processed audio signals for the two or more microphones to generate a set of adjusted audio signals; and (2) selecting the representative, central value as a median or average of the adjusted audio signals.

29. The invention of claim 28, wherein the nonlinear signal estimation processing comprises the step of selecting the representative, central value as a median of the processed audio signals.

30. The invention of claim 28, wherein:

step (1) comprises the steps of:

(i) adjusting the value of the n highest values down to match the $(n+1)^{th}$ highest data value, where n is a non-negative integer; and (ii) adjusting the value of the m lowest values up to match the $(m+1)^{th}$ lowest data value, where m is a non-negative integer; and step (2) comprises the step of selecting the representative, central value as an average of the processed audio signals.

31. The invention of claim 30, wherein the average is a weighted average.

32. A method for processing audio signals generated by an array of two or more microphones, comprising the steps of:

(a) filtering the audio signal from each microphone to generate a processed audio signal for each microphone; and (b) combining the processed audio signals in a nonlinear manner to form an acoustic beam that focuses the array on one or more desired regions in space by performing nonlinear signal estimation processing on the processed audio signals from the microphones to generate an output signal for the array, wherein the nonlinear signal estimation processing discriminates against noise originating at an unknown location outside of the one or more desired regions, wherein:

the nonlinear signal estimation processing is based on multiple values from each processed audio signal over a period of time; and the nonlinear signal estimation processing comprises the steps of:

applying temporal filtering to the input values of each processed audio signal;

generating a distance measure between pairs of audio signals; and generating the output signal from the one or more audio signals having the smallest distance measures to attempt to match each of the processed audio signals.

33. A method for processing audio signals generated by an array of two or more microphones, comprising the steps of:

(a) filtering the audio signal from each microphone to generate a processed audio signal for each microphone; and (b) combining the processed audio signals in a nonlinear manner to form an acoustic beam that focuses the array on one or more desired regions in space by performing nonlinear signal estimation processing on the processed audio signals from the microphones to generate an output signal for the array, wherein the nonlinear signal estimation processing discriminates against noise originating at an unknown location outside of the one or more desired regions, wherein the nonlinear signal estimation processing picks a representative, central value from the processed audio signals, by altering at least one extreme value from at least one of the processed audio signals, wherein the nonlinear signal estimation processing comprises the steps of:

(1) dropping one or more of the highest and lowest values of the processed audio signals to generate a set of adjusted audio signals; and (2) selecting the representative, central value as an average of the adjusted audio signals.

34. The invention of claim 33, wherein the average is a weighted average.

35. A method for processing audio signals generated by an array of two or more microphones, comprising the steps of:

(a) filtering by delaying and scaling the audio signal from at least one microphone to generate a processed audio signal for each microphone; and (b) combining the processed audio signals for the two or more microphones in a nonlinear manner that suppresses effects of high values to form an acoustic beam that focuses the array on one or more desired regions in space by performing nonlinear signal estimation processing on the processed audio signals from the microphones to generate an output signal for the array, wherein:

the nonlinear signal estimation processing discriminates against noise originating at an unknown location outside of the one or more desired regions; and the filtering of step (a) is dynamically adjusted to attempt to match each of the processed audio signals in amplitude and phase to each other and to the output signal.

36. A method for processing audio signals generated by an array of two or more microphones, comprising the steps of:

(a) filtering the audio signal from each microphone to generate a processed audio signal for each microphone; and (b) combining the processed audio signals in a nonlinear manner that suppresses effects of high values to form an acoustic beam that focuses the array on one or more desired regions in space by performing nonlinear signal estimation processing on the processed audio signals from the microphones to generate an output signal for the array, wherein:

the nonlinear signal estimation processing discriminates against noise originating at an unknown location outside of the one or more desired regions;

the nonlinear signal estimation processing picks a representative, central value from the processed audio signals, by altering at least one extreme value from at least one of the processed audio signals; and step (a) comprises the step of applying a digital filter corresponding to the inverse of each transfer function from a desired focal point to each microphone to compensate for reverberation in a volume containing the array.

* * * * *

UNITED STATES PATENT AND TRADEMARK OFFICE

CERTIFICATE OF CORRECTION

PATENT NO. : 7,046,812 B1
APPLICATION NO. : 09/575910
DATED : May 16, 2006
INVENTOR(S) : Gregory P. Kochanski and Man M. Sondhi It is certified that error appears in the above-identified patent and that said Letters Patent is hereby corrected as shown below:

Column 20, line 31, replace "to attempt to match each of the processed audio signals." with --with other audio signals.--

Signed and Sealed this

Fifteenth Day of August, 2006

JON W. DUDAS
*Director of the United States Patent and Trademark Office*